US008272095B2

(12) United States Patent
Verscheure et al.

(10) Patent No.: US 8,272,095 B2
(45) Date of Patent: Sep. 25, 2012

(54) NOTCHED SPATULA APPLICATOR AND ADHESIVE COMPOSITION FOR LAYING PARQUET

(75) Inventors: Eric Verscheure, Vernou la Celle sur Seine (FR); Laurent Nery, Bry sur Marne (FR)

(73) Assignee: Bostik S.A., Courbevoie (FR)

( * ) Notice: Subject to any disclaimer, the term of this patent is extended or adjusted under 35 U.S.C. 154(b) by 563 days.

(21) Appl. No.: 12/176,884

(22) Filed: Jul. 21, 2008

(65) Prior Publication Data

US 2009/0044364 A1 Feb. 19, 2009

(30) Foreign Application Priority Data

Jul. 20, 2007 (FR) ..... 07 05246
Nov. 2, 2007 (FR) ..... 07 07694

(51) Int. Cl.
*B05C 17/10* (2006.01)

(52) U.S. Cl. ..... 15/235.4; 15/235.6; 15/245.1; 15/236.08

(58) Field of Classification Search ..... 15/235.4, 15/235.6, 245.1, 236.8
See application file for complete search history.

(56) References Cited

U.S. PATENT DOCUMENTS

| | | | | |
|---|---|---|---|---|
| 3,611,470 | A | 10/1971 | Gaston | |
| 3,803,662 | A | 4/1974 | Glejf | |
| 4,982,470 | A | 1/1991 | Szabo | |
| 6,167,585 | B1 * | 1/2001 | Fridman et al. | 15/245.1 |
| 6,205,610 | B1 * | 3/2001 | Westthorp | 15/235.4 |
| 7,370,384 | B2 * | 5/2008 | Miller et al. | 15/236.08 |
| 2004/0181025 | A1 | 9/2004 | Schindler | |
| 2005/0119421 | A1 | 6/2005 | Schindler | |

FOREIGN PATENT DOCUMENTS

| | | |
|---|---|---|
| FR | 1 051 074 A | 1/1954 |
| FR | 2 710 675 | 4/1995 |
| FR | 2 751 357 | 1/1998 |
| FR | 2 787 116 A | 6/2000 |
| FR | 2 823 519 A | 10/2002 |
| WO | WO 98/55713 A | 12/1998 |
| WO | WO 02/100555 | 12/2002 |

OTHER PUBLICATIONS

Search Report (EPO Form 1503) in French Application No. FR 07.05246.
Search Report (EPO Form 1503) in French Application No. FR 07.07694.

* cited by examiner

*Primary Examiner* — Shay Karls
(74) *Attorney, Agent, or Firm* — Hunton & Williams LLP

(57) ABSTRACT

The invention relates to a notched spatula applicator (1) including gripping means (3) connected to a spatula (2) of which the straight working edge (2*c*) is equipped with a plurality of notches (4) that are identical and evenly spaced apart by a distance between 35 and 50 mm, the width of said notches being between 9 and 18 mm and their height between 8 and 20 mm.
The invention also relates to a process for laying, by bonding, rigid floorcoverings, especially parquet, which uses said applicator and an adhesive composition comprising from 0.2 to 5 wt % of substantially spherical particles of a material for which the substantially identical diameter may range from 1 to 7 mm.
The invention finally relates to the adhesive composition used in said process.

22 Claims, 4 Drawing Sheets

NOTCHED SPATULA APPLICATOR AND ADHESIVE COMPOSITION FOR LAYING PARQUET

One subject of the present invention is a notched spatula applicator. The notched spatula applicator is useful in enabling the implementation of a process for laying, by bonding, rigid floorcoverings, especially parquet, by means of an adhesive composition which is also one subject of the invention. The invention further relates to the installation process, which gives the floor thus covered sound insulation properties.

BACKGROUND OF THE INVENTION

The reduction in noise pollution in places of residence is a widespread concern and quietness appears to be the first criteria of choice in the search for housing. Furthermore, noise is the first ground for dissatisfaction when the occupants of apartments talk about their housing.

The clack of shoes on the flooring of one floor of a place of residence when walking, the dropping of an object or the moving of furniture are some examples of activities which are a source of noise pollution for the occupants of the lower floor. These various impact noises cause the vibration of the flooring, which is transmitted through the whole of the structure and especially in the ceiling of the lower floor, and which then radiates in the ambient air of the latter.

Rigid coverings, and especially parquet or tiled floors, contribute as components of the floor to the transmission of impact noises, and therefore to the acoustic comfort of the occupants of places of residence. Generally, the quality of the sound insulation against the impact noises required for parquet flooring is measured by the value of the expression $\Delta Lw$ (expressed in decibels or dB) in accordance with the EN ISO 717-2 standard.

Parquet is a wood-based floorcovering, of which the components of rectangular shape (denoted by the terms strips, boards or panels) may be laid according to various processes over the surface of the underlying support. The latter is usually a concrete slab, rough or covered with a levelling compound. The support may also be, in the case of renovating an existing dwelling, another material such as tiling, metal or else a wood-based floor.

Among the various installation processes, parquet known as bonded parquet is often used due to an advantageous mechanical and dimensional stability, in the face of temperature and hygrometry variations in the surrounding atmosphere. These variations may lead, over time, to an expansion of the components of the parquet which risks resulting—in extreme situations—in the delamination and/or lifting up of the boards. This mechanical stability is often evaluated by a measurement of the delamination strength of strips of parquet in a direction perpendicular to the surface of the support.

The laying of such parquet requires a prior step of applying and/or spreading the adhesive over the support.

A notched spatula applicator denoted hereinafter by the term "spatula No. 4," which is illustrated as a front view in FIG. 3, is well known in the art.

According to FIG. 3, the "spatula No. 4" 1 comprises a spatula 2 which is in the strict sense of the word a wide and flexible blade of rectangular or trapezoid shape, in general metallic and usually made from stainless steel, and which is equipped over the entire length of its working edge 2*c* with a fine serration. The spatula 2 is directly attached to a handle 3, for example made of wood. The fine serration of the spatula 2, represented schematically in FIG. 3, results from the juxtaposition of notches (or recesses) 4 which each have the shape of a triangle of height 3.8 mm and of base 4.2 mm, and which are spaced 4.8 mm apart.

The spatula No. 4 is held in the hand by the operator (or layer) in order to use it. The latter works by leaning on the support by means of his knees and optionally one hand. From a container (for example a pot) he removes, using the spatula, a certain amount of adhesive which he deposits on the support. While pressing the working edge of the flexible blade against the surface of the support, he then handles the spatula so as to give the amount of adhesive the form of a substantially homogeneous layer, constituted of parallel and essentially contiguous filaments.

The strips of parquet are, after a waiting period of a few tens of minutes, applied to the thus coated support.

Such a process, in which the adhesive is applied in the form of a substantially homogeneous layer onto the support is denoted in the trade by the terminology of "continuous bonding".

The spatula No. 4 from FIG. 3 however forces the operator to remain on his knees during the entire time necessary to carry out his task, which leads to discomfort and pain when working, most particularly for laying coverings over vast surfaces.

Notched spatula applicators have been developed for the purpose of overcoming this drawback. These applicators are devices in which the notched spatula is indirectly connected, especially via a rod, to gripping means, which enable it to be handled by the operator in the standing position. Such applicators are, for example, described in international Application WO 02/100555 and in U.S. Pat. No. 3,611,470, U.S. Pat. No. 3,803,662 and U.S. Pat. No. 4,982,470. These devices are used for applying adhesive according to the continuous-bonding process.

The process of continuous bonding, carried out in particular using a notched spatula tool such as the spatula No. 4, is very widely used by the professionals for laying parquet, due to the particularly advantageous mechanical and dimensional stability of the laid parquet that it provides, and also for its ease and rapidity of implementation. However, the quality of the sound insulation to the impact noises provided by parquet bonded according to this process is very inadequate.

Another process for laying parquet that is used in practice is the process known as "bead bonding". According to this process, the adhesive is contained in a sealed container (or cartridge) placed in a gun, and is deposited onto the surface of the support to be coated by extrusion through a cannula (or nozzle), in the form of a bead, the diameter of which is defined by the diameter of the nozzle, generally between 3 and 15 mm. These beads are positioned by the fitter in a substantially parallel manner on the surface of the support and evenly spaced apart by around 10 to 20 cm. This process is especially used for compensating for the presence of defects in the flatness of the support to be coated.

Various processes for bead bonding that aim to improve the acoustic comfort of places of residence are already known in the prior art.

Thus, French Patent Application 2710675 describes a process that consists in placing, between the beads of adhesive (separated by 5 to 20 cm), seals that limit the squashing of the beads during laying of the parquet, so as to make between the parquet and the support an air space that provides sound and thermal insulation. However, the laying of these seals complicates and further lengthens the fitting time.

French Patent Application 2751357 describes a process comprising the application, to the support, of an insulating sublayer that has a plurality of recesses intended to receive the beads of the adhesive for attaching the parquet. Such a sub-layer however involves a very significant additional cost.

French Patent Application 2787116 describes a process for depositing, in beads, a bonding material made up of a binder and comprising less than 5% of polymer or rubber grains having a size of around 1 to 6 mm as a bulk additive.

The process of bead bonding, which requires a cartridge placed in a gun, and which is carried out in these 3 patent applications, has several drawbacks relative to the continuous-bonding process. As a result it has a lower dimensional stability of the laid parquet, with a lower delamination strength. Due to the time necessary to extrude beads via the cannula of the cartridge, it takes longer to carry out; it is also more expensive. These drawbacks are even greater when the surface area of parquet to be laid is larger.

BRIEF SUMMARY OF THE INVENTION

An installation process with bonding of a rigid covering (especially parquet) to a support has now been found that overcomes these various drawbacks, while giving the thus covered support advantageous properties of acoustic damping and an acceptable mechanical stability. This process uses a notched spatula applicator and an adhesive composition which are also subject matters of the invention.

Therefore, a first subject of the invention is a notched spatula applicator comprising gripping means connected to a spatula of which the straight working edge is equipped with a plurality of notches that are identical and evenly spaced, characterized in that the width of the notches is between 9 and 18 mm, their height is between 8 and 20 mm, and in that they are evenly spaced apart by a distance between 35 and 50 mm.

BRIEF DESCRIPTION OF THE DRAWINGS

The features and advantages of the invention will be better understood on reading the following figures, among which.

DETAILED DESCRIPTION OF THE PREFERRED EMBODIMENT

The spatula contained in the notched spatula applicator according to the invention is a wide and flexible blade which may have the shape of a rectangle or of an isosceles trapezium. It is generally made of a metal, usually steel, and preferably stainless steel.

The number of notches varies along the length of the working edge of the spatula.

Figure 2A:
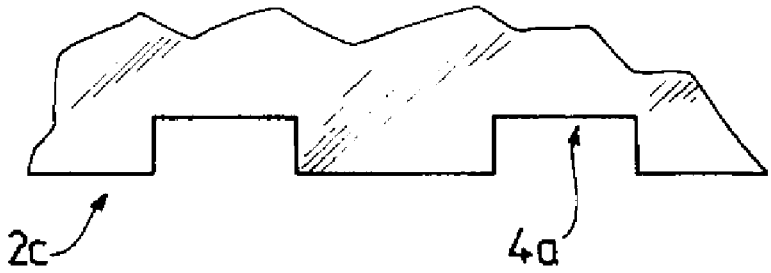
FIGS. 2A to 2F schematically show an enlarged and detailed front view of various embodiments of notches positioned on the straight working edge of the spatula which is included in the notched spatula applicator according to the invention.
Figure 2B:
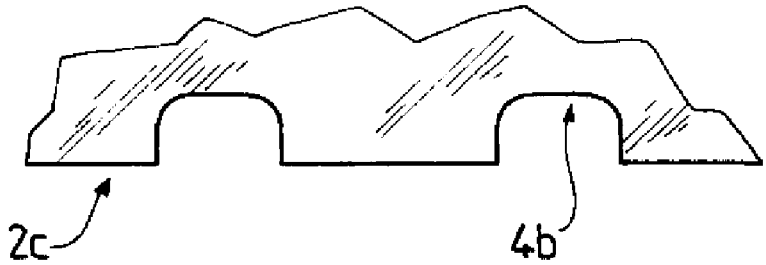
Figure 2C:
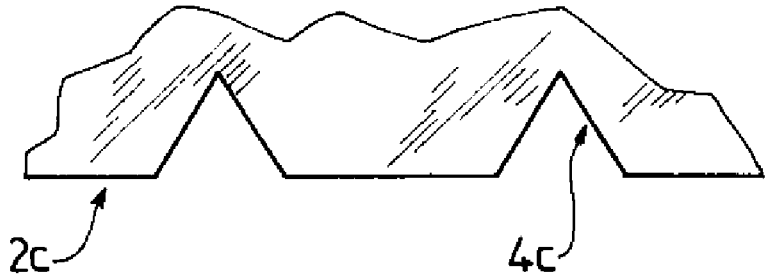
Figure 2D:
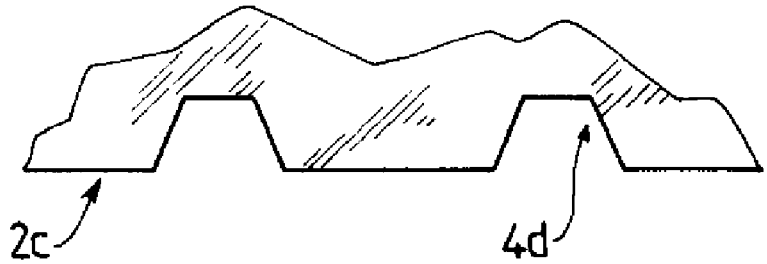
Figure 2E:
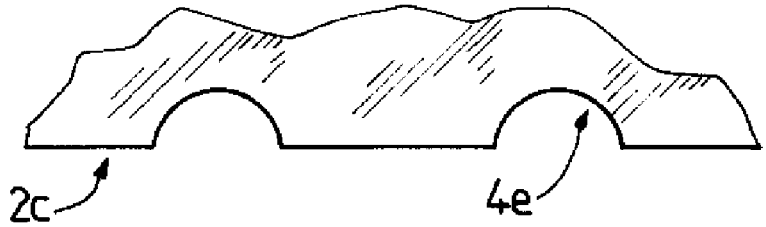
Figure 2F:
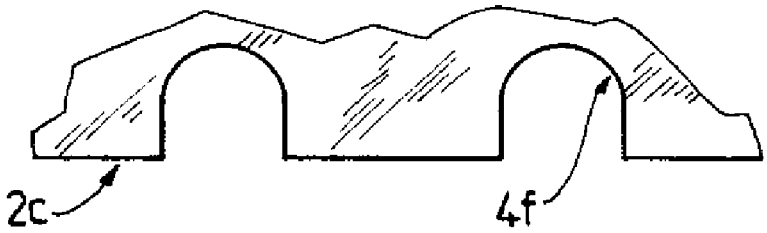
Figure 3:
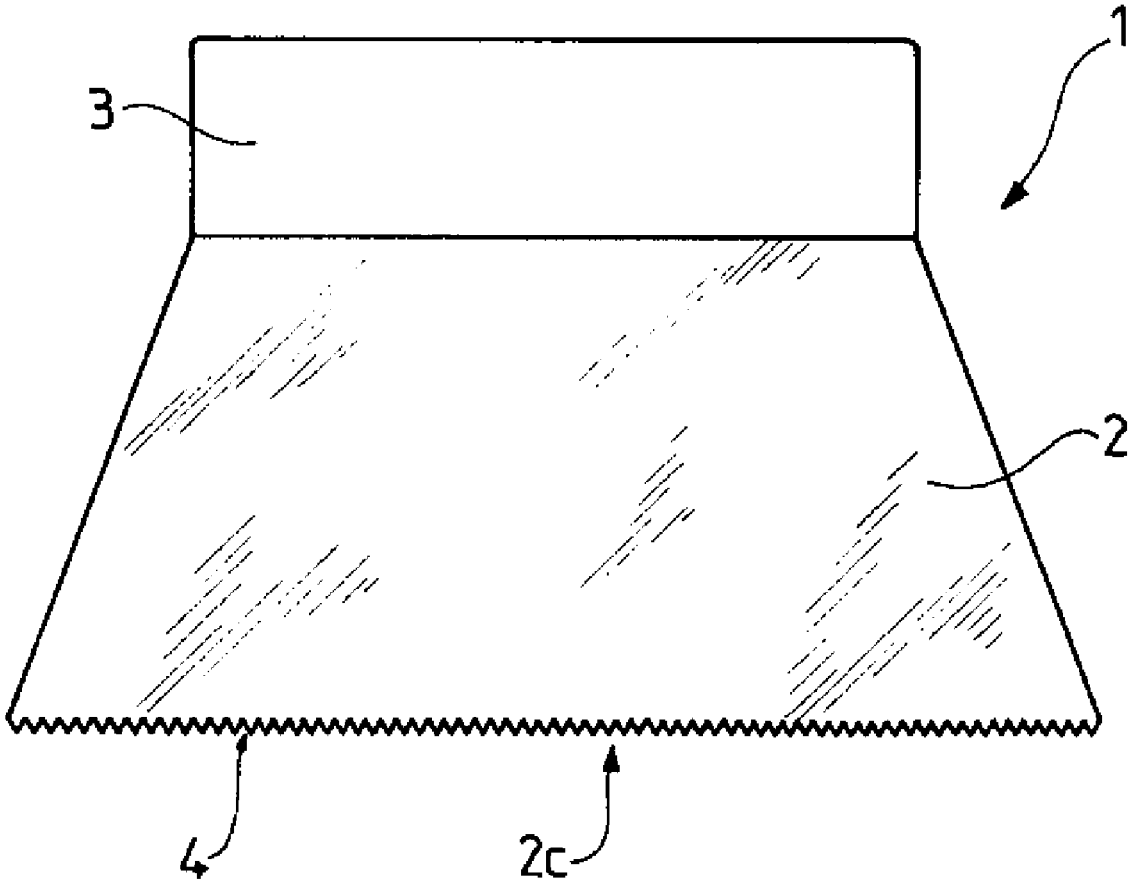
FIG. 3 Prior Art
FIG. 3 schematically represents a front view of the spatula No. 4 known from the prior art.

FIGS. 2A to 2F schematically show front views of various possible shapes for the notches 4 which are positioned on the working edge 2*c* of the spatula:

- notch 4*a* in the shape of a rectangle (FIG. 2A) or notch 4*b* in the shape of a U-shaped rounded rectangle (FIG. 2B).
- notch 4*c* in the shape of an isosceles triangle (FIG. 2C) the base of which corresponds to the width of the notches, as defined previously;
- notch 4*d* in the shape of an isosceles trapezium (FIG. 2D) the widest base of which corresponds to the width of the notches, as defined previously; or else
- notch 4*e* in the shape of a semicircle (FIG. 2E) of which the diameter and the radius respectively correspond to the width and the height of the notches, as defined previously; and
- notch 4*f* in the shape of a rectangle bordered by a semicircle (FIG. 2F).

According to one preferred variant of the applicator, the width and the height of the notches range from 10 to 16 mm.

According to another preferred variant, the notches are evenly spaced apart by a distance between 35 and 45 mm, a distance of around 4 cm being even more particularly preferred.

According to one most particularly preferred embodiment variant of the notched spatula applicator according to the invention, the notches of the spatula are notches 4*b* in the form of a U-shaped rounded rectangle, of which the height varies from 10 to 12 mm and the width varies from 10 to 15 mm.

According to a first embodiment, the spatula is directly connected to the gripping means, which then consist of a handle (or grip). This embodiment makes it possible to obtain a notched spatula tool which may be held in the hand and easily handled, due to its grip, by the operator, who must then work kneeing down and bent over the support to be bonded.

The working edge of such a tool generally has a length between 15 and 40 cm, preferably between 20 and 30 cm, and is more preferably still around 25 cm. The number of notches located on the working edge may then vary from 3 to 8, and advantageously from 4 to 6. A number of notches equal to 4 is particularly advantageous.

Figure 1:
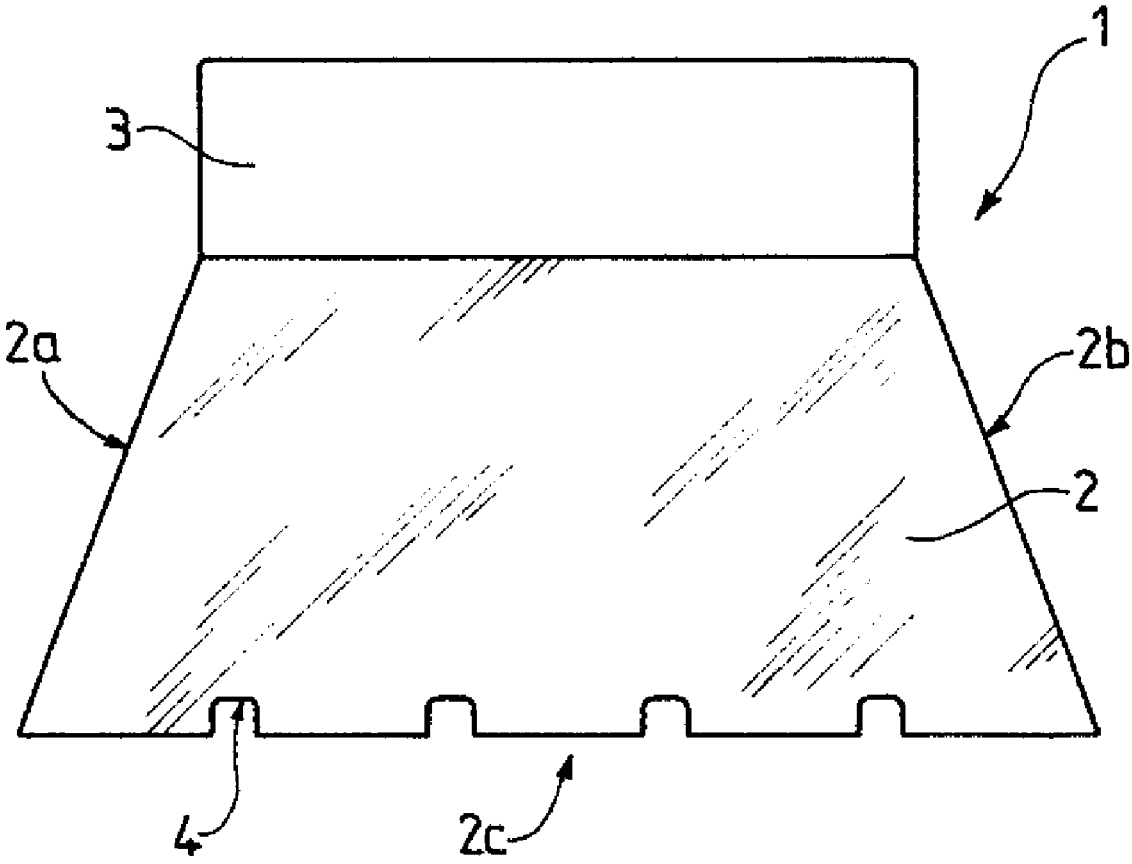
FIG. 1 schematically represents a front view of an embodiment of a notched spatula applicator according to the invention.

FIG. 1 schematically illustrates a front view of a first variant of this first embodiment, according to which the notched spatula tool 1 comprises a blade (or spatula) 2 in the shape of an isosceles trapezium, inserted into and attached to, along the edge opposite the working edge 2*c*, a rectangular wooden grip 3. The spatula 2 is provided with two straight side edges 2*a* and 2*b* of the same length and an essentially straight front edge (or working edge) 2*c* having a length of 25 cm. This front edge 2*c* is equipped with 4 identical notches (or recesses) 4 having a square shape with sides of 10 mm and rounded corners. These notches are evenly spaced apart by around 4 cm. Such a notched spatula tool is described in the remainder of the present text by the term "10-10," with reference to the width and to the height of its notches.

Two other variants of this first embodiment relate to two notched spatula tools that are identical to that which is the subject of the first variant, apart from the shape of the notches which is respectively a square having sides of 12 mm and a rectangle having a width of 15 mm and a height of 10 mm. These 2 notched spatula tools are described in the remainder of the present text by the respective terminology "12-12" and "15-10".

According to a second embodiment, the spatula is connected indirectly to the gripping means via a rod that has a length enabling the operator to work in a standing position. The corresponding device then comprises the spatula, the gripping means and the rod in combination with one or more of the components known from the prior art documents cited previously.

According again to a third embodiment of the notched spatula applicator according to the invention, the spatula is equipped along its straight working edge, outside of the notches with a fine serration.

Figure 4:
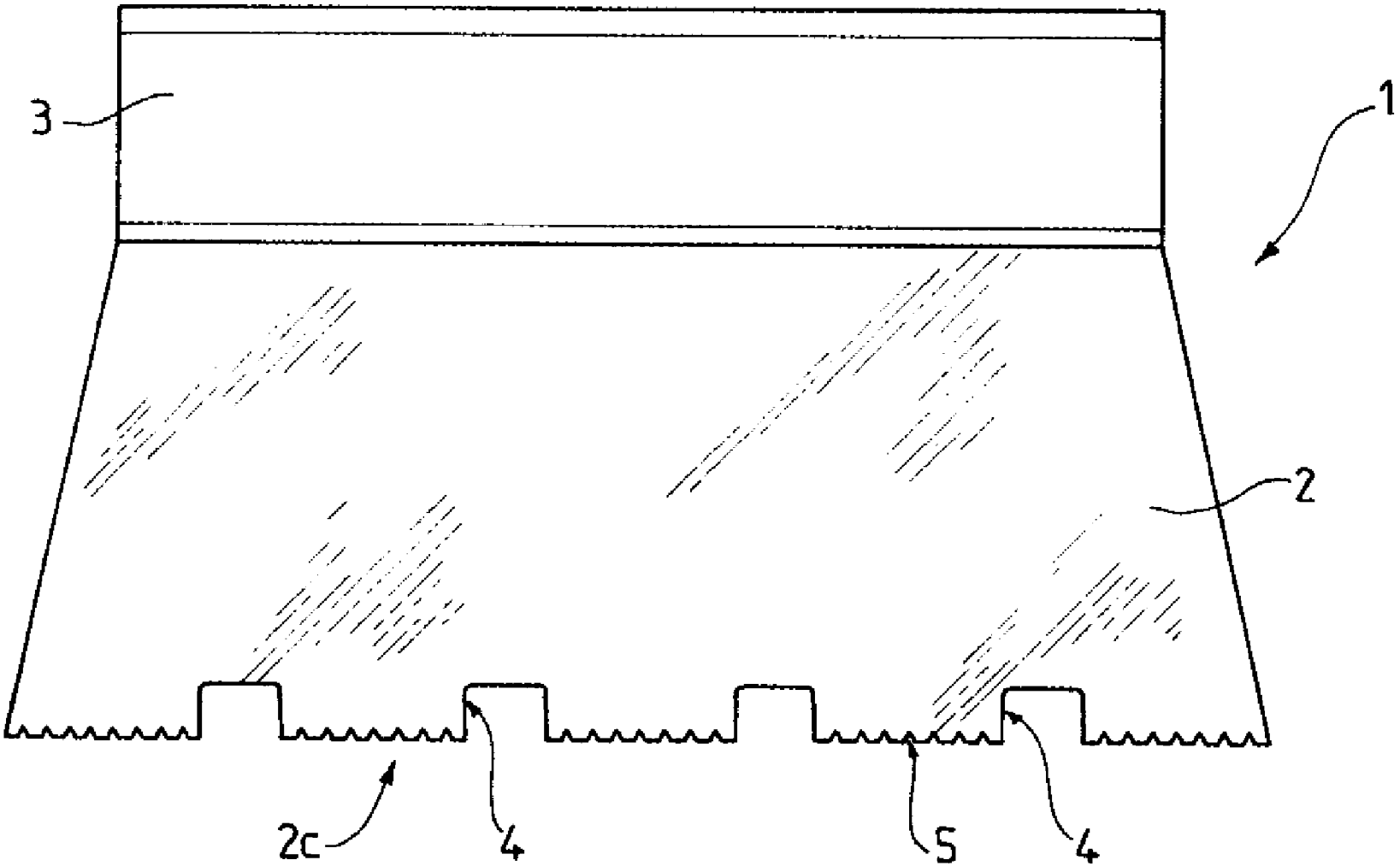
FIG. 4 schematically represents a front view of an embodiment of a notched spatula applicator according to the invention.

As illustrated in FIG. 4, this fine serration is located over the entire length of the working edge 2*c* of the spatula 2 between the notches 4 described previously and up to 2 ends of the edge. This fine serration advantageously consists of a juxtaposition of recesses 5 in the form of identical isosceles triangles evenly spaced apart by a distance that varies from 1 to 2 mm, of which the base may range from 1.5 to 2.5 mm and the height from 1 to 2 mm.

Another subject of the present invention is a process of laying, by bonding, rigid floorcoverings, characterized in that it comprises a step of spreading over the substantially flat surface of a support, by means of the notched spatula applicator described previously, an adhesive composition comprising from 0.2 to 5 wt % of substantially spherical particles of a material for which the substantially identical diameter may range from 1 to 7 mm.

The adhesive composition is also a subject of the present invention, as are the embodiments described below.

The substantially spherical particles contained in the composition constitute a substantially monodisperse population for which the ratio of the 90% and 10% quantiles of the distribution curve for the diameters, namely D90/D10, is between 0.9 and 1.1, preferably between 0.95 and 1.05. The adhesive composition helps to obtain advantageous properties of sound insulation and of mechanical stability of the process according to the invention, while ensuring perfect flatness and horizontality of the parquet after laying.

According to one preferred variant of the adhesive composition according to the invention, the material used is a polymer.

The particles contained in the adhesive composition are, for example, particles of polypropylene or of EPDM (ethylene-propylene-diene monomer) produced by injection-moulding, moulding or extrusion processes. The corresponding products are commercially available, for example from the Belgian company Saluc.

According to one preferred variant of the process according to the invention, the diameter of the substantially spherical particles may range from 3 to 7 mm and more preferably still from 4 to 6 mm.

According to yet another preferred variant, the amount, by weight, of the particles of material contained in the adhesive composition is in the interval ranging from 0.5 to 4%.

The adhesive compositions according to the invention are obtained by incorporation of the spherical particles of material in a mixture made up of other ingredients and homogenization of the whole mixture carried out, for example, using a Rayneri®-type blade mixer.

The adhesive compositions likely to be suitable for bonding rigid coverings to the floors of places of residence, and more particularly for bonding parquet, generally comprise a bonding tie which is either:

- a blend of polyisocyanate and of polyol (for two-component polyurethane adhesives); or else
- a polymer or copolymer of the type that can be crosslinked by atmospheric moisture.

The latter type of bonding tie encompasses polymers of low molecular weight (or prepolymers) which comprise end groups capable of reacting with the moisture in the air during a reaction known as crosslinking. This crosslinking reaction occurs during drying which immediately follows the use of the adhesive composition during the laying of the parquet, and results in the establishment of chemical bonds between the prepolymer chains, and subsequently in the formation of a three-dimensional polymeric network. This network constitutes the joint that ensures the adhesion of the parquet to the support. The adhesive composition according to the invention may comprise one or more polymers of the type which have just been defined.

According to one preferred variant, the polymer (or copolymer) included, as a bonding tie, in the adhesive composition is of the type that can be crosslinked by atmospheric moisture. It is advantageously chosen from:

(i) a polyurethane with isocyanate end groups (the chemical bond established during crosslinking being a urea bond); or (ii) a polyether having silyl end groups; or (iii) a polyether (such as polypropylene glycol) comprising a silyl end group (such as, for example, a $—Si(CH_3)(OCH_3)_2$ group) bonded to a divalent hydrocarbon-based radical having from 1 to 4 carbon atoms which is itself attached to the ends of the polymer chain via a urethane functional group.

Polymers of type (i) and (ii) are commercially available, the polymers (ii) for example being sold by Kaneka.

Polymers of type (iii) may be prepared via processes that are known per se, for example from patents US 2005/0119421 or US 2004/0181025.

In cases (ii) and (iii), the chemical bond established during crosslinking is a siloxane bond.

The polymers described previously are in general used in the adhesive composition that is used in the process according to the invention in combination with one or more fillers such as calcium carbonate, kaolin, talc, silica and/or one or more plasticizers which are usually an ester of a polycarboxylic acid and of a linear or branched aliphatic alcohol. Among the polycarboxylic acids, phthalic acid, adipic acid, oleic acid or maleic acid can especially be used.

According to one more particularly preferred variant of the process according to the invention, the substantially spherical particles contained in the adhesive composition have a diameter which is less than or equal to around half the width of the notches of the spatula contained in the applicator. This results in an easier implementation of the process, and an improved degree of homogeneity for the composition once applied.

The installation process via bonding according to the invention is suitable for laying any rigid covering on the floor such as: wood covering that is in the form of squares, strips or panels, tiling, synthetic coverings that are in the form of slabs or rigid strips.

It is preferred to carry out the process for laying parquet.

The application (or spreading) of the adhesive composition using the notched spatula applicator, conforming to the process according to the invention, comprises:

(i) a step of depositing a certain amount of the composition onto the surface of the support, in the immediate vicinity of the spatula; then (ii) a step of moving the applicator itself to keep the straight working edge of the spatula pressed against the surface and to provide the spatula with an essentially straight movement along a fixed direction, so as to give to the amount the shape of straight cylinders that have, as the base, the surface delimited by a notch of the spatula.

These cylinders are spaced apart over the surface of the support by a distance corresponding to the spacing between the notches along the straight working edge of the spatula.

The amount of adhesive composition applied to the surface of the support varies depending on the nature of the composition, especially of the binder and of its density. A dose of 1 to 3.5 $kg/m^2$ and preferably of 1 to 2.5 $kg/m^2$ is generally suitable.

The process according to the invention comprises, besides the step of spreading the adhesive composition over the surface of the support, a step of drying at ambient temperature for a time of 1 to 40 minutes.

When, according to a preferred variant of the process according to the invention, the rigid covering to be laid is parquet, the strips of the parquet are advantageously laid perpendicular to the cylinders of adhesive composition.

The implementation of the process according to the invention by means of the embodiment of the notched spatula applicator illustrated in FIG. 4 is advantageous when it is necessary to bond vast support surfaces. This is because it results in an improvement of the ease of use for the operator especially as regards the physical effort to be exerted on the tool, and a more homogeneous distribution of the adhesive over the support. Furthermore, the fine serration with which the working edge of the spatula is equipped is a useful indicator signalling the degree of wear of the latter and the need to replace the tool.

The following examples of the process and of the adhesive composition that are subject matters of the invention are given purely by way of illustration. They should not be interpreted as limiting the scope thereof.

Example 1 a) Adhesive Composition

The adhesive TARBICOL® MS ELASTIC sold by Bostik was used, for which the bonding tie (denoted hereinafter by Polymer A) was a polyether with silyl end groups. 1 kg of this product was poured into a bucket and 1 wt % of EPDM beads having a diameter of 6 mm obtained from Saluc SA were dispersed by a Rayneri blade mixer. The D90/D10 ratio of the beads used was around 1.

b) Notched Spatula Applicator

The notched spatula tool 15-10 defined previously was used to apply the adhesive composition.

c) Implementation Process

A square concrete slab having sides of 50 cm and a thickness of 5 cm was used as a support.

The adhesive composition a) was spread manually over the surface of this slab by a fitter using the notched spatula tool 15-10, so as to deposit on the surface 8 parallel beads spaced around 4 cm apart, corresponding to a total amount (or dose) relative to the unit of surface area, of 1.9 kg/m$^2$.

After a waiting period of 5 minutes, 18 strips of parquet were laid which were placed perpendicular to the beads of adhesive composition a), so as to completely cover the surface of the slab. The strips of parquet used were oak strips having a width of 5.5 cm, a length of 25 cm and a thickness of 10 mm.

The slab covered with bonded parquet was then stored at ambient temperature for 7 days, then subjected to the following 2 tests:

1) Sound Insulation Test:

The preceding slab was embedded in a square hollowed-out housing fitted, for this purpose, at the centre of the square upper face of an acoustic metal box having a height of 70 cm and sides of 1 m. This box was insulated from outside noise by walls fitted with cellular foam.

Placed on the slab of bonded parquet was an impact machine, a source of impact noise. The impact machine used was composed of 5 hammers placed in a line, the weight of one hammer being 500 grams falling in freefall perpendicular to the surface of the parquet, from a height of 40 mm at a rate of 10 blows per second.

The sound level of the noise emitted by the impact machine on the bonded parquet was measured inside the acoustic box by a microphone placed in the centre of the box 10 cm below the flooring tested. This sound level was measured for various frequency bands between 100 and 5000 Hz.

The sound insulation was calculated with reference to the sound level measured for the bare, uncovered concrete slab, and was expressed in decibels by a single value known as ΔLw, in accordance with the EN ISO 717-2 standard.

A ΔLw value of 17.4 dB was measured.

2) Delamination Strength Test:

Measured for the slab of bonded parquet obtained previously was the strength of resistance to separation (or delamination) between a strip of parquet and the concrete support, under the effect of a tensile force exerted in a direction perpendicular to the plane of the slab.

The tensile force was generated by means of a tensile testing machine and was transmitted to the strip of parquet via a metal rod, the base of which substantially covered the strip and which had a T-shaped profile.

This metal rod was firmly attached to the strip of parquet by bonding its base using an epoxy adhesive, the adhesive seal obtained having a cohesion very significantly greater than that of the bond between the strip and the concrete surface. The vertical part of the metal rod (corresponding to the vertical bar of the T) was firmly attached to the axle of the tensile testing machine by a pin.

A tensile test was then carried out and the value of the delamination strength, expressed in N/mm$^2$, was noted.

A value of 0.153 N/mm$^2$ was measured.

Example 2

Example 1 was repeated, incorporating 2 wt % of beads into the adhesive composition.

Example 3

Example 1 was repeated, incorporating 3 wt % of beads into the adhesive composition.

Example 4

Example 1 was repeated using the notched spatula tool 12-12.

Example 5

Example 1 was repeated, using 0.7% of polypropylene beads having a diameter of 4 mm and applying the adhesive composition using the notched spatula tool 10-10.

Example 6

Example 5 was repeated, using 1% of polypropylene beads.

Example 7

Example 5 was repeated, using beads having a diameter of 5.5 mm.

Example 8

Example 1 was repeated:

using, as a bonding tie (denoted hereinafter by Polymer B), a polymer comprising a methyldimethoxysilyl end group attached to the ends of a polypropylene glycol chain via a methylene radical and a urethane functional group; and applying the adhesive composition using the notched spatula tool 12-12 defined previously.

Example 9

Example 8 was repeated, using 0.7% of polypropylene beads in the adhesive composition.

Example 10

Example 9 was repeated, using, as a bonding tie (denoted hereinafter by Polymer C), a polyurethane having isocyanate end groups. The adhesive composition used was TARBICOL® PU MONO sold by Bostik.

Example 11

Example 10 was repeated, using beads having a diameter of 4 mm and applying the adhesive composition using the notched spatula tool 10-10.

The characteristics of the process and of the adhesive composition illustrated in Examples 1 to 11 and the results obtained for ΔLw and the delamination strength are collated in the following table.

| | Adhesive composition | | | | | | | |
|---|---|---|---|---|---|---|---|---|
| Example | Tie | Material of the beads | Diameter of the beads (mm) | Bead content (wt %) | Notched spatula tool | Amount applied (kg/m$^2$) | ΔLw (dB) | Delamination strength (N/mm$^2$) |
| 1 | Polymer A | EPDM | 6 | 1 | 15-10 | 1.9 | 17.4 | 0.153 |
| 2 | Polymer A | EPDM | 6 | 2 | 15-10 | 1.9 | 15.6 | 0.153 |
| 3 | Polymer A | EPDM | 6 | 3 | 15-10 | 1.9 | 15.8 | 0.142 |
| 4 | Polymer A | EPDM | 6 | 1 | 12-12 | 2.3 | 15.8 | 0.174 |
| 5 | Polymer A | Polypropylene | 4 | 0.7 | 10-10 | 1.3 | 14.4 | 0.131 |
| 6 | Polymer A | Polypropylene | 4 | 1 | 10-10 | 1.3 | 14.6 | 0.131 |
| 7 | Polymer A | Polypropylene | 5.5 | 0.7 | 10-10 | 1.3 | 15 | 0.091 |
| 8 | Polymer B | EPDM | 6 | 1 | 12-12 | 2.3 | 15.4 | 0.214 |
| 9 | Polymer B | Polypropylene | 6 | 0.7 | 12-12 | 2.3 | 16 | 0.156 |
| 10 | Polymer C | Polypropylene | 6 | 0.7 | 12-12 | 2.3 | 16 | 0.062 |
| 11 | Polymer C | Polypropylene | 4 | 0.7 | 10-10 | 1.3 | 15.4 | 0.127 |

The invention claimed is:

1. A notched spatula applicator comprising a grip portion connected to a spatula, the spatula comprising a straight working edge equipped with a plurality of notches that are identical and evenly spaced, the width of said notches is between 9 and 18 mm, the height of said notches is between 8 and 20 mm, and the notches are evenly spaced apart by a distance of between 35 and 50 mm, wherein the height and width of the notches permits application of an adhesive including substantially spherical particles having diameters ranging from 3 to 7 mm in parallel beads spaced apart by the distance between the notches.

2. The notched spatula applicator according to claim 1, wherein the spatula is made of stainless steel.

3. The notched spatula applicator according to claim 1, wherein the width and the height of the notches ranges from 10 to 16 mm.

4. The notched spatula applicator according to claim 1, wherein the notches are evenly spaced apart by a distance between 35 and 45 mm.

5. The notched spatula applicator according to claim 1, wherein the notches are evenly spaced apart by a distance of around 4 cm.

6. The notched spatula applicator according to claim 1, wherein the notches are in the form of a U-shaped rounded rectangle, of which the height ranges from 10 to 12 mm and the width ranges from 10 to 15 mm.

7. The notched spatula applicator according to claim 1, wherein the spatula is directly connected to the gripping means which comprises a handle.

8. The notched spatula applicator according to claim 7, wherein the length of the working edge is between 20 and 30 cm.

9. The notched spatula applicator according to claim 7, wherein the number of notches located on the working edge ranges from 4 to 6.

10. The notched spatula applicator according to claim 7, wherein the working edge has a length of around 25 cm and the number of notches is equal to 4.

11. The notched spatula applicator according to claim 1, wherein the spatula is connected indirectly to the gripping means via a rod that has a length enabling the operator to work in a standing position.

12. The notched spatula applicator according to claim 1, wherein the spatula is equipped along its straight working edge, outside of the notches, with a fine serration including a juxtaposition of recesses in the form of identical isosceles triangles evenly spaced apart by a distance that ranges from 1 to 2 mm, of which the base may range from 1.5 to 2.5 mm and the height may range from 1 to 2 mm.

13. A process of laying, by bonding, rigid floorcoverings, comprising a step of spreading over the substantially flat surface of a support, by means of the notched spatula applicator of claim 1, an adhesive composition comprising from 0.2 to 5 wt % of substantially spherical particles of a material for which the substantially identical diameter ranges from 1 to 7 mm.

14. The process according to claim 13, wherein the substantially spherical particles contained in the adhesive composition comprise a substantially monodisperse population for which the ratio of the 90% and 10% quantiles of the distribution curve for the diameters, namely D90/D10, is between 0.9 and 1.1.

15. The process according to claim 13, wherein the material of the particles included in the adhesive composition is a polymer.

16. The process according to claim 13, wherein the diameter of the substantially spherical particles included in the adhesive composition ranges from 3 to 7 mm.

17. The process of claim 16, wherein the diameter of the substantially spherical particles included in the adhesive composition ranges from 4 to 6 mm.

18. The process according to claim 13, wherein the amount, by weight, of the particles of material included in the adhesive composition ranges from 0.5 to 4%.

19. The process according to claim 13, wherein the adhesive composition comprises, as a bonding tie, a crosslinkable polymer or copolymer that is crosslinked by atmospheric moisture.

20. The process according to claim 13, wherein the substantially spherical particles included in the adhesive composition have a diameter which is less than or equal to around half the width of the notches of the spatula included in the applicator.

21. The process according to claim 13, wherein the floor coverings are parquet.

22. A notched spatula applicator for applying an adhesive comprising a grip portion connected to a spatula, the spatula comprising a straight working edge equipped with a plurality of notches of a shape of an appropriate size for uniformly distributing a plurality of substantially spherical particles included within the adhesive, the width of said notches is between 9 and 18 mm, the height of said notches is between 8 and 20 mm, and the notches are evenly spaced apart by a distance of between 35 and 50 mm, wherein the height and width of the notches permits application of an adhesive including substantially spherical particles having diameters ranging from 3 to 7 mm in parallel beads spaced apart by the distance between the notches.

* * * * *

UNITED STATES PATENT AND TRADEMARK OFFICE

CERTIFICATE OF CORRECTION

PATENT NO. : 8,272,095 B2
APPLICATION NO. : 12/176884
DATED : September 25, 2012
INVENTOR(S) : Verscheure et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 895 days.

Signed and Sealed this
Twenty-sixth Day of August, 2014

Michelle K. Lee

Michelle K. Lee
*Deputy Director of the United States Patent and Trademark Office*